US008125417B2

(12) United States Patent
Furuichi

(10) Patent No.: US 8,125,417 B2
(45) Date of Patent: Feb. 28, 2012

(54) DISPLAY DRIVER CIRCUIT FOR DRIVING A LIGHT-EMITTING DEVICE WITH THE THRESHOLD OFFSET OF A DRIVE TRANSISTOR COMPENSATED FOR

(75) Inventor: Shuji Furuichi, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 541 days.

(21) Appl. No.: 12/398,381

(22) Filed: Mar. 5, 2009

(65) Prior Publication Data

US 2009/0244044 A1 Oct. 1, 2009

(30) Foreign Application Priority Data

Mar. 27, 2008 (JP) ..... 2008-082319

(51) Int. Cl.
*G09G 5/00* (2006.01)

(52) U.S. Cl. ..... 345/76; 345/77; 345/82; 345/211

(58) Field of Classification Search ..... 345/77, 345/78, 82, 84, 87, 89, 98, 100, 204; 315/169.3
See application file for complete search history.

(56) References Cited

U.S. PATENT DOCUMENTS 7,372,390 B2 5/2008 Yamada
2008/0036708 A1 * 2/2008 Shirasaki et al. ..... 345/76

FOREIGN PATENT DOCUMENTS

JP 2006-301250 11/2006

* cited by examiner

*Primary Examiner* — Will J Klimowicz
*Assistant Examiner* — Andrew Sasinowski
(74) *Attorney, Agent, or Firm* — Volentine & Whitt, PLLC

(57) ABSTRACT

A display driver circuit for driving a current-controlled light-emitting device to emit light with a luminance gradation includes a memory for storing compensation data based on a measured value of a threshold voltage of a transistor for driving the light-emitting device, a register for holding the data to be displayed, and a data line driver for measuring the threshold voltage of the transistor through a data line connected to the transistor to produce the compensation data and store the compensation data in the memory and correcting the data to be displayed held in the register with the compensation data stored in the memory to output the gradation signal to the data line. Thus, the display driver circuit can be smaller in size than conventional circuitry which has a separate analog-to-digital converter.

4 Claims, 4 Drawing Sheets

DISPLAY DRIVER CIRCUIT FOR DRIVING A LIGHT-EMITTING DEVICE WITH THE THRESHOLD OFFSET OF A DRIVE TRANSISTOR COMPENSATED FOR

BACKGROUND OF THE INVENTION

1. Field of the Invention

The present invention relates to a display driver circuit and a method for driving a display display device such as a current-drive type of light-emitting device such as an organic electro luminescence (EL) device.

2. Description of the Background Art

Currently, liquid crystal display (LCD) devices have been extensively used as light, thin, low power consumption display device. To fully disseminate as successive generation of the LCD, research and development have been made on display devices containing self-luminous devices arranged in a matrix form, such as organic EL devices, inorganic EL devices or light emitting diodes (LEDs). A display device including the self-luminous devices has its response speed more improved than an LCD device and its viewing characteristics not affected by viewing angle, thereby having the possibility of attaining its improvable viewing intensity, contrast and definition. In addition, unlike the LCD device, the self-luminous display device requires no backlight, so that the device can be made thinner and lighter and can contribute further low power consumption.

In order to display gradation on a self-luminous display device, the display device has its display screen formed by a lot of pixels, for each of which a light-emitting device and switching devices for driving the light-emitting device have to be provided. Generally, a light-emitting drive circuit, of which detailed description will be made later, comprises a switch transistor for causing, when enabled by the associated selector line, the associated capacitor to hold display data, or a gradation signal, fed from the associated data line, and a drive transistor for supplying the light-emitting device with current according to the gradation signal held in the capacitor. To these transistors, applicable are single-channel amorphous silicon thin-film transistors which may be manufactured in a simpler process and a reuniform in operational properties. The thin-film transistor is, however, notorious for its threshold voltage (VT) typically variable, or set off, due to its drive history, i.e. VT shift being notably caused.

If the threshold voltage of the drive transistor varies, the currents supplied to the light-emitting devices do not correspond to data to be displayed, so that they cannot appropriately emit light with gradation in luminance. The threshold voltage of the light-emitting devices is dependent upon the history of light-emission thereof, i.e. the history of the drive transistors driven in the past, thus resulting in fluctuation in light-emission properties of the display devices to deteriorate the quality of an displayed image.

In order to solve those problems, Japanese patent laid-open publication No. 2006-301250 discloses a display driver, in which the threshold voltage of a drive transistor of each light-emitting drive circuit is measured prior to displaying an image to produce compensation data for each pixel based on the measurement results, and then a voltage corresponding to data to be displayed is added to a voltage corresponding to the compensation data, thereby correcting a driving voltage to feed it to the light-emitting drive circuit.

This conventional display driver is adapted to measure, in advance of the drive operation for displaying, the threshold voltage of the light-emitting drive transistor of each display pixel on the display screen to store the measurement result as threshold compensation data, and then, during a drive operation for displaying, produce a compensation voltage from the threshold compensation data to correct the gradation effective voltage representative of display data externally provided with the compensation voltage, thus adaptively controlling the current passing through the drive transistor for driving the light-emitting device. The conventional display driver thus can compensate the fluctuation, or offset, in threshold voltage due to the drive history of the drive transistor so as not to cause deterioration in display image quality.

The conventional display driver, however, requires a digital-to-analog converter for generating a compensation voltage for compensating for fluctuation in voltage threshold of the light-emitting drive transistor as well as an analog-to-digital converter for producing a threshold detection voltage for use in measuring the threshold voltage. It therefore poses a problem of an increase in circuit size, thus leading to an increase in area for laying out circuit elements.

SUMMARY OF THE INVENTION

It is therefore an object of the present invention to provide a display driver circuit with fluctuation in light-emission property due to the drive history of a drive transistor for light-emission compensated for with circuit size minimized.

In accordance with the present invention, a display driver circuit for supplying a gradation signal according to externally input display data to be displayed to a display pixel having a current-controlled light-emitting device and a transistor for supplying a drive current to the light-emitting device to thereby allow the light-emitting device to emit light with a luminance gradation comprises: a memory for storing compensation data based on a measured value of a threshold voltage of the transistor; a register for holding the display data; and a data line driver having a data line connected to the transistor for measuring the threshold voltage of the transistor through the data line to produce the compensation data and store the compensation data in the memory during a threshold voltage measurement, which includes a voltage applying process for applying a detection voltage to the data line, a voltage converging process for making the applied voltage converge to the threshold voltage level of the transistor and a voltage reading process for storing the threshold data in the memory, and is carried out prior to a display operation for getting the light-emitting device to emit the light, and, during the display operation, for correcting the display data held in the register with the compensation data stored in the memory to output the gradation signal to the data line. The data line driver comprises: a counter for executing, during the voltage reading process, a counting operation in synchronous with a clock signal; a selector for selecting detection data to feed a detection voltage for threshold measurement to the data line during the voltage applying process, selecting a count value of the counter during the voltage converging process and the voltage reading process, and selecting and outputting the compensation data stored in the memory during the display operation; a digital-to-analog converter circuit for converting, during the threshold voltage measurement, the data selected by the selector into a corresponding analog voltage to output the analog voltage, and supplying, during the display operation, an analog voltage corresponding to data into which the display data held in the register are corrected with the compensation data selected by the selector; an operational amplifier serving as a voltage follower during the voltage applying process and the display operation for applying a voltage output from the digital-to-analog converter circuit to the data line, and serving as a voltage comparator during the voltage converging process and the voltage reading process for comparing the output voltage from the digital-to-analog converter circuit with the voltage on the data line; and a data holder for monitoring a comparison result in the operational amplifier during the voltage reading process. The data holder is responsive to the result being inverted to hold the count value of the counter as the threshold voltage.

In the present invention, the connection of the operational amplifier for driving the data line to which the drive transistor is connected is changed to serve either as a voltage follower when applying an analog voltage to the data line, or as a voltage comparator when measuring the threshold voltage of the drive transistor which appears on the data line. Consequently, a digital-to-analog converter circuit for generating a detection voltage or a compensation voltage may be utilized as part of an analog-to-digital converter circuit. In this way, the present invention has an advantage in reducing the size of the display driver circuit having circuitry for compensating the fluctuation in light-emission properties caused by the drive history of a drive transistor for driving light-emission.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
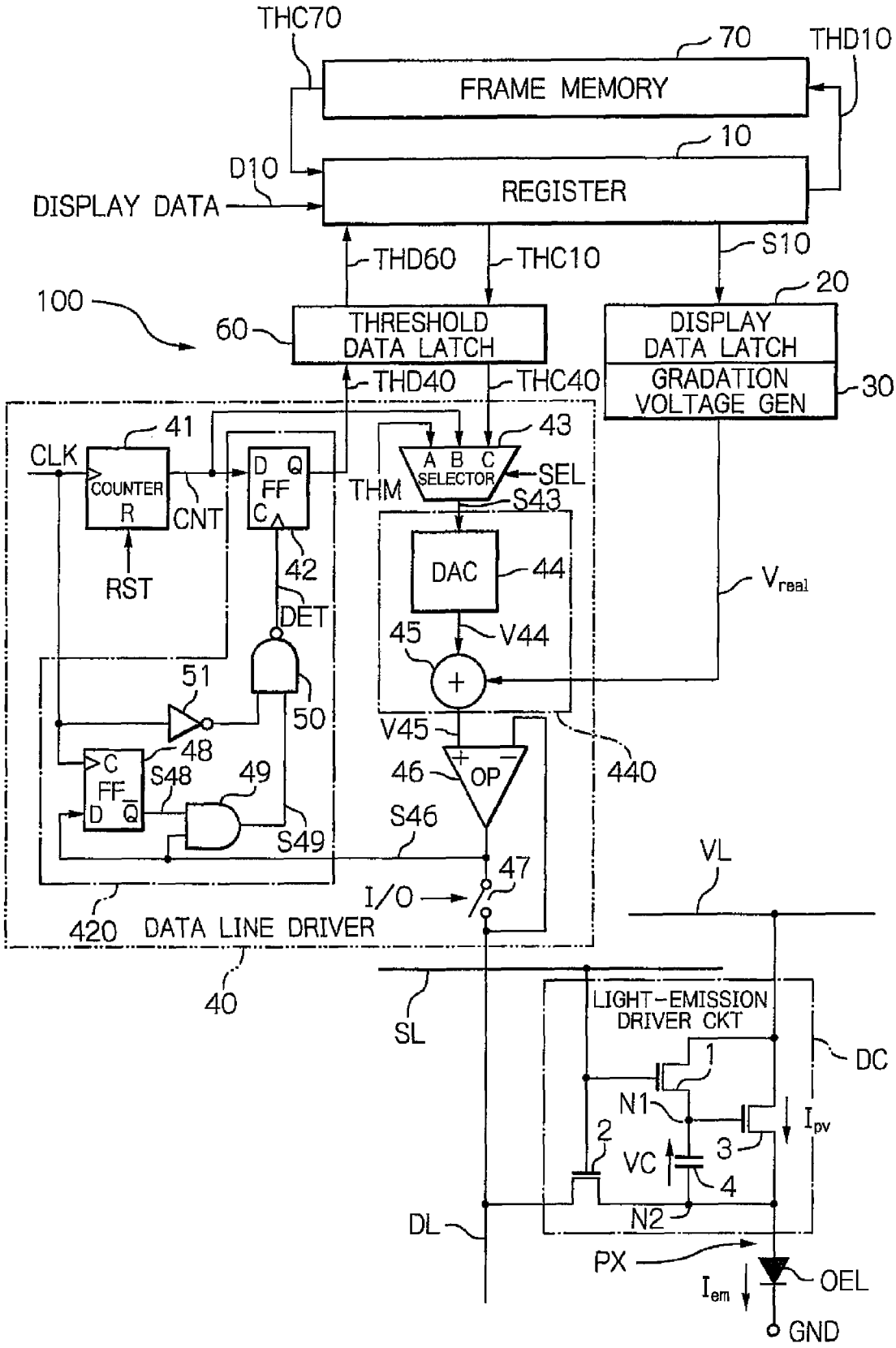
FIG. 1 is a schematic block diagram showing a preferred embodiment of a display drive circuit in accordance with the present invention.

With reference to the accompanying drawings, preferred embodiments of the present invention will now be described in detail. It is to be noted that the specific details shown in the drawings do not intend to restrict the scope of the invention.

FIG. 1 is a schematic block diagram illustrating a preferred embodiment of a display driver circuit 100 in accordance with the present invention. The display driver circuit 100 is operable to drive a display panel forming a display screen and comprising an array of display pixels PX, each of which consists of a light-emission driver circuit DC and an organic electro luminescence (EL) device OEL that are arranged in a matrix form of rows or lines and columns substantially perpendicular to each other. The display driver circuit 100 comprises a register 10, a display data latch 20, a gradation voltage generator 30, a data line driver 40, a threshold data latch 60 and a frame memory 70, which are connected as illustrated.

On the display screen, a plurality of selector lines SL are disposed in its row direction, i.e. lateral direction in the figure, and a plurality of data lines DL are disposed in its column direction, or vertical direction in the figure. Each of the display pixels PX is disposed in the vicinity of a cross point where one of the selector lines SL intersects one of the data lines DL. Each pixel PX consists of the light-emission driver circuit DC and the organic EL device OEL. The selector lines SL and data lines DL are connected for conveying signals to, respectively, select one of the lines of pixels and drive some of the pixels on the line thus selected which are correspondent to data to be displayed, i.e. display data. Although the display screen includes plural display pixels, of course, FIG. 1 only shows one of the display pixels.

The light-emission driver circuit DC includes transistors 1 and 2 serving as switches, a drive transistor 3 and a capacitor 4 for holding a gradation display voltage. The transistor 1 has its gate, drain and source electrodes connected to the selector line SL, a power supply voltage line VL and a node N1, respectively, while the transistor 2 has its gate, drain and source electrodes connected to the selector line SL, the data line DL and a node N2, respectively. The transistor 3 has its gate, drain and source electrodes connected to the node N1, the power supply voltage line VL and the node N2, respectively, and the capacitor 4 is connected between the nodes N1 and N2. Furthermore, to the node N2 connected is an anode of the organic EL device OEL, which has its cathode connected to a common or reference voltage, e.g. a ground potential GND.

In the preferred embodiment, the display driver circuit 100 is implemented as an organic EL type of display panel. However, the light-emitting device applicable to the display driver circuit 100 may not limited to the specific type of organic EL device, but to any current-drive display devices, such as inorganic EL device or light emitting diode.

The register 10 serves as a shift register to store therein digital signals externally supplied in series to sequentially output the stored signal. More specifically, the register 10 is adapted to selectively execute any one of the following operations: receiving data to be displayed corresponding to one row of display pixels PX on the display screen sequentially supplied from outside to transfer the received data to the display data latch 20; sequentially reading out threshold detection data in one row of display pixels PX which are held in the threshold data latch 60 over a line THD60 connecting an output of the latch 60 to an input of the register 10 to transfer the read-out data to the frame memory 70; or sequentially reading out threshold compensation data in a specific row of display pixels PX from the frame memory 70 to transfer the data thus read out to the threshold data latch 60. The register 10 has its inputs D10, THD60 and THC70 for receiving the data to be displayed, the threshold detection data and the threshold compensation data, respectively, and its outputs THC10 and THD10 for developing the threshold detection data and the data to be displayed, respectively.

The display data latch 20 is adapted to hold the data to be displayed in one row of display pixels PX transferred from the register 10 over the connection S10. The gradation voltage generator 30 is configured to generate a gradation effective voltage $V_{real}$ for driving the organic EL device OEL for luminous display according to the data to be displayed fed from the display data latch 201.

The data line driver 40 is adapted for correcting, during a display operation, the gradation effective voltage $V_{real}$ output from the generator 30 and representative of the data to be displayed with a compensation voltage $V_{pth}$ to drive the data line DL. The data line driver 40 has a function of detecting, in advance of the display operation, the threshold compensation data to generate the compensation voltage $V_{pth}$. More specifically, the data line driver 40 has functions of taking in, in the form of analog voltage, a threshold voltage of the transistor 3 adapted for supplying a light-emission drive current to the organic EL device OEL of each display pixel PX to convert the analog voltage into corresponding threshold detection data in a digital form, and of converting the threshold compensation data fed by the threshold data latch 60 into an analog compensation voltage pth and adding the gradation effective voltage $V_{real}$ to the compensation voltage to output a gradation designating voltage $V_{data}$ for driving the data line DL. Note that although only one data line driver 40 is depicted in FIG. 1, the driver 40 is practically provided for each data line DL, that is, correspondingly to the number of display pixels that constitute one line.

The data line driver 40 includes a counter 41 for counting a clock signal CLK to output a resultant count value CNT, and a flip-flop (FF) 42 for holding the count value CNT in time with a detection signal DET supplied to output the held value as the threshold detection data to an input THD 40 of the threshold data latch 60. The count value CNT is also supplied to an input terminal B of a selector 43. Thus, signals are designated with reference numerals or codes of connections on which they are conveyed.

In the preferred embodiment, the counter 41 is designed to increment in synchronous with the clock signal CLK, but may be adapted to decrement, of course. Furthermore, in a display device including the display drive circuits 100, the data line driver is needed to be provided for each line of display pixels. However, if any one of the data line drivers 40 includes the counter 41, the remaining drivers 40 do not have to include own counter like the counter 41. That is, the remaining data line drivers can use the count values CNT of the counter 41 in common.

The selector 43 is adapted to select either one of its input terminals A, B and C in response to a selection signal SEL to accordingly output data S43 received on the selected terminal. The input terminals A and C of the selector 43 are respectively supplied with threshold measuring data THM and the threshold compensation data supplied from an output THC 40 of the threshold data latch 60. Note that the threshold measuring data THM has a fixed value for generating a detection voltage $V_{pv}$ of which the absolute value is larger than the total value of threshold voltages $V_{th2}$ and $V_{th3}$ of the respective transistors 2 and 3, e.g. −10 V, so as to feed the generated voltage to the data line DL.

To the output side of the selector 43 is connected a digital-to-analog converter (DAC) 44, which has its output connected to a voltage adder 45. The voltage adder 45 is adapted for adding an analog voltage V44 output from the digital-to-analog converter 44 to the gradation effective voltage $V_{real}$ delivered from the gradation voltage generator 30 to output a resultant analog voltage V45. The voltage adder 45 has its output connected to a noninverting input terminal of an operational amplifier (OP) 46. By connecting the digital-to-analog converter 44 to the voltage adder 45 in this way, a DAC unit 440 is configured for outputting either an analog voltage converted from the data selected by the selector 43 or an analog voltage obtained by correcting the gradation effective voltage $V_{real}$ with the data selected by the selector 43.

The operational amplifier 46 has its output port connected to the data line DL and also to its inverting input terminal via a switch 47 which is controlled in its conduction state ON and OFF in response to a switch control signal I/O. The output of the operational amplifier 46 is also connected to a data terminal D of a flip-flop 48 as well as to one input terminal of a dual-input AND gate 49. The flip-flop 48 is operable to hold an output signal from the operational amplifier 46 in time with the clock signal CLK and invert the signal level of the held signal to output the resultant signal from its inverting output terminal/Q. The inverting output terminal/Q of the flip-flop 48 is connected to the other input terminal of the AND gate 49.

The AND gate 49 has its output connected to one input terminal of a dual-input NAND gate 50, of which the other input terminal is supplied with a clock signal into which the clock signal CLK is inverted by an inverter 51. Furthermore, a signal output from the NAND gate 50 is delivered as the detection signal DET to a clock terminal of the flip-flop 42. By connecting the flip-flops 42 and 48, the AND gate 49 and the NAND gate 50 in this way, a data holder 420 is configured for monitoring a comparison result in the operational amplifier 46 during a voltage reading process to hold, when the result is inverted, a count value in the counter 41 as threshold detection data THD.

The threshold data latch 60 has its input THD40 and output THD60 connected to the output of the flip-flop 42 and the input of the register 10, respectively, to transfer the threshold detection data. The latch 60 also has its input THC10 and output THC60 connected to the output of the register 10 and the input terminal C of the selector, respectively, to transfer the threshold compensation data.

The threshold data latch 60 is arranged to selectively execute either of the following operations: reading and holding the threshold detection data THD in one row of display pixels PX generated by the data line driver 40 to sequentially transfer the derived data via the register 10 to a frame memory 70; and reading out and holding the threshold compensation data corresponding to one row of display pixels PX in the frame memory 70 to transfer the data to the data line driver 40.

The frame memory 70 is adapted to sequentially receive the threshold detection data of each display pixel PX of the display screen detected by the data line driver 40 via the output THD10 of the register 10, and store the data correspondingly to the respective display pixels PX on one screen, or frame, of the display panel. The memory 70 is also adapted to output in series the stored data as threshold compensation data through the input THC70 of the register 10 in order to transfer the data to the threshold data latch 60.

The driver circuit 100 in accordance with the present invention is thus formed by the register 10, the display data latch 20, the threshold data latch 60 and the frame memory 70. However, this configuration is a mere example, and can be modified as long as it includes a register for temporarily holding the data to be displayed and a memory for storing the compensation data based on the measured value of the threshold voltage of the drive transistor 3.

Figure 2:
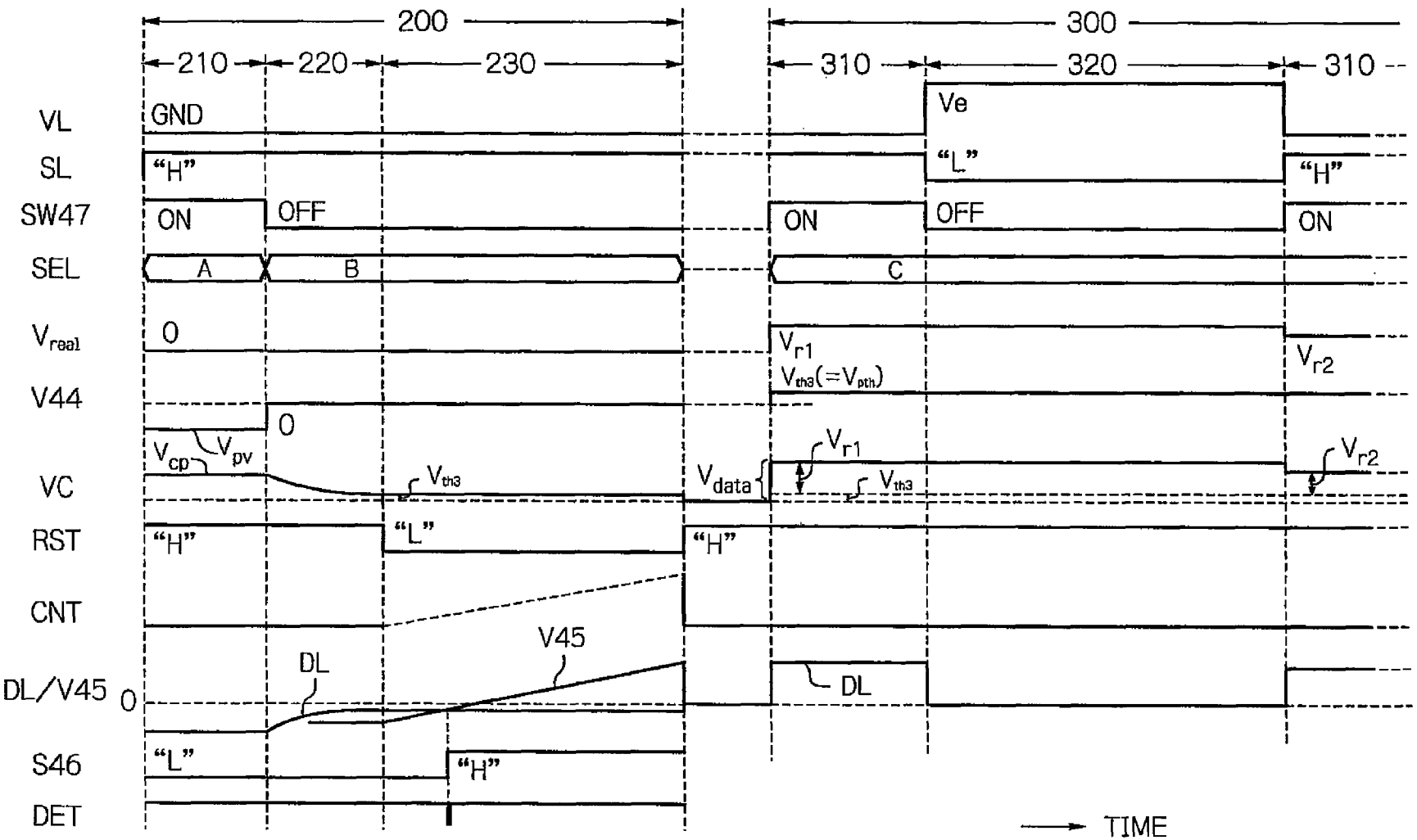
FIG. 2 is a timing diagram useful for understanding the operation of the display driver circuit shown in FIG. 1.

FIG. 2 is a timing chart for use in describing operations of the display driver circuit 100 shown in FIG. 1. As illustrated in FIG. 2, the operations of the display driver circuit 100 are generally classified as a threshold voltage detection operation 200 for measuring the threshold voltage of the transistor 3 for light-emit driving of each display pixel PX on the display screen to store the threshold compensation data, and as a display drive operation 300 for correcting the gradation effective voltage $V_{real}$ representing data to be displayed based on the threshold compensation data acquired by the threshold voltage detection operation 200 to drive the organic EL device OEL according to the corrected voltage for light emission. Furthermore, the threshold voltage detection operation 200 can be separated into three stages, e.g. a voltage applying stage 210, a voltage converging stage 220 and a voltage reading stage 230. The display drive operation 300 can be separated into a writing stage 310 and a light emission stage 320.

In the following, the operation concerning the circuit shown in FIG. 1 will be described with reference to FIG. 2. In the voltage applying stage 210 of the threshold voltage detection operation 200, the register 10 is externally fed with data to be displayed representing all black pixels, and the display data latch 20 in turn holds the black pixel data. Consequently, the gradation effective voltage $V_{real}$ is output from the gradation voltage generator 30 as a non-light emitting display voltage $V_{zero}$ for displaying black. In addition, the power supply voltage line VL is fed with a low potential power supply voltage, i.e. ground potential GND in the illustrative embodiment, and the voltage of the selector line SL is set to its high ("H") level. Furthermore, the switch 47 is turned on in response to the switch control signal I/O to establish a voltage follower connection in the operational amplifier 46, while the input terminal A of the selector 43 is selected in response to the selection signal SEL. The counter 41 is held in its reset state in response to a reset signal RST at its "H" level.

Consequently, the selector 43 selects the threshold measuring data THM to feed the data to the digital-to-analog converter 44, which in turn outputs the detection voltage $V_{pv}$, of which the value is −10 V in the illustrative embodiment. By means of the voltage adder 45, the detection voltage $V_{pv}$ is added to the non-light emitting display voltage $V_{zero}$, which is in practice equal to 0 V, output from the gradation voltage generator 30, and then applied to the data line DL via the operational amplifier 46 forming the voltage follower. The detection voltage $V_{pv}$ on the data line DL is supplied through the transistor 2, now turned on by the selector line SL, to the node N2. On the other hand, the ground potential GND on the power supply voltage line VL is fed through the transistor 1, turned on by the selector line SL, to the node N1.

Since the detection voltage $V_{pv}$ is substantially lower than the ground potential GND and has its absolute value set larger than the total value of the threshold voltages $V_{th2}$ and $V_{th3}$ of their respective transistors 2 and 3, a voltage $V_{cp}$ higher than the threshold voltage $V_{th3}$ is applied between the gate and source electrodes of the transistor 3. It causes a forcible flow of a large detection current $I_{pv}$ depending on the voltage $V_{cp}$ from the power supply voltage line VL to the operational amplifier 46 via the drain and source electrodes of the transistor 3. As a consequence, an inter-terminal voltage VC across the capacitor 4 rapidly goes to the voltage $V_{cp}$.

During the voltage converging stage 220, the switch 47 is turned off in response to the switch control signal I/O, and the selector 43 switches the input terminal A to the input terminal B in response to the selection signal SEL. The other setting conditions are the same as in the voltage applying operation 210. That is, the selector line SL is at its "H" level, and the power supply voltage line VL is connected to the ground potential GND. The display data latch 20 holds the black pixel data, and the gradation voltage generator 30 outputs the non-light emitting display voltage $V_{zero}$. Furthermore, the reset signal RST is at its "H" level.

The selector 43 thus selects the count value CNT of the counter 41. Since the counter 41 at this time is in its reset state, the count value CNT is zero, and thus the output of the detection voltage $V_{pv}$ from the digital-to-analog converter 44 is stopped. Moreover, the operational amplifier 46 works as not a voltage follower but a voltage comparator because the switch 47 is in its OFF, or disconnection, state.

In this situation, the transistors 1 and 2 of the light-emission driver circuit DC keep their ON states, so that the electrical connection is held between the circuit DC and the data line DL. However, because the switch 47 is in its OFF state, the current flow to the data line DL is cut off. Consequently, the one plate of the capacitor 4, that is, the node N2 becomes high impedance state.

At this time, the electrical charges or the voltage $V_{cp}$ accumulated in the capacitor 4 maintains the gate voltage of the transistor 3, which thus remains in its ON state, thereby allowing the current to continuously flow between the drain and source electrodes of the transistor 3. As a result, the electric potential of the source electrode of the transistor 3 gradually increases to the potential level of the drain electrode, i.e. the power supply voltage line VL. As a consequence, the electrical charges accumulated in the capacitor 4 is partially discharged, resulting in decrease of the voltage between the gate and source electrodes of the transistor 3, and thereby the voltage between the gate and source electrodes of the transistor 3 finally converges onto the threshold voltage $V_{th3}$ of the transistor 3. The current flowing between the drain and source electrodes of the transistor 3 also decreases and stops eventually.

Furthermore, in the voltage reading stage 230, the reset signal RST becomes low ("L") level, and the reset status of the counter 41 is then released. The other setting conditions are the same as in the voltage converging operation 220. More specifically, the selector line SL is at its "H" level, and the power supply voltage line VL is connected to the ground potential GND. The display data latch 20 holds the black pixel data, and the gradation voltage generator 30 outputs the non-light emitting display voltage $V_{zero}$. In addition, the selector 43 selects the count value CNT delivered to the input terminal B, the switch 47 is in its OFF state, and the operational amplifier 46 works as a voltage comparator.

In such a connection state, the data line driver 40 serves as an analog-to-digital converter for measuring the voltage on the data line DL and outputting the measurement result in the for of digital value. As the operation of the data line driver 40 will be described in detail later, only a brief illustration will be made herein.

The counter 41 is synchronous with the clock signal CLK to start counting up and supplies a resultant count value CNT via the selector 43 to the digital-to-analog converter 44, by which the count value CNT is converted to a corresponding analog voltage, which will be compared with the voltage of the data line DL by the operational amplifier 46 or the voltage comparator. Whenever the voltage output from the digital-to-analog converter 44 exceeds the voltage on the data line DL, a signal S46 output from the operational amplifier 46 changes from its "L" to "H" level. The flip-flop 48 and the AND gate 49 responds to the timing of the change in the signal S46, and the AND gate 49 outputs a signal S49 which is rendered by the NAND gate 50 and the inverter 51 to a detection signal DET synchronous with the positive-going edge of the clock signal CLK. The count value CNT is then held in the flip-flop 42 in response to the positive-going edge of the detection signal DET and is output as threshold detection data THD to the threshold data latch 60.

The threshold detection data THD are temporarily held in the threshold data latch 60, then successively read out by the register 10 for one row of display pixels PX, and sequentially stored in a certain memory area of the frame memory 70. The threshold voltage detecting operation 200 is executed sequentially for each line of the display screen, or frame, and terminated when the threshold voltages detected in all lines are stored in the frame memory 70.

The threshold detection data THD of each display pixel PX of the display screen thus stored in the frame memory 70 are used as the threshold compensation data for data to be displayed fed from outside, and the next display drive operation 300 is performed.

In the writing stage 310 of the display drive operation 300, one line of display data to be actually displayed is externally input to the register 10 and held in the display data latch 20. In response, the gradation voltage generator 30 outputs the gradation effective voltage $V_{real}$ correspondent to the data to be displayed. Furthermore, the register 10 transfers to the threshold data latch 60 threshold compensation data of a specific row of display pixels PX stored in the frame memory 70, which correspond to the data to be displayed held in the display data latch 20.

In addition, to the power supply voltage line VL is applied a low-potential supply voltage, i.e. ground potential GND with the illustrative embodiment, and the selector line SL is set to its "H" level. The switch 47 is then turned on in response to the switch control signal I/O to establish a voltage follower connection in the operational amplifier 46, while the input terminal C of the selector 43 is selected in response to the selection signal SEL. Furthermore, the counter 41 is kept in its reset state by the "H" level reset signal RST. Consequently, the gradation voltage generator 30 outputs the gradation effective voltage $V_{real}$ based on the data to be displayed, and the digital-to-analog converter 44 outputs the compensation voltage $V_{pth}$ based on the threshold compensation data.

The gradation effective voltage $V_{real}$ and the compensation voltage $V_{pth}$ are added together by the voltage adder 45, and the resultant voltage is then applied as gradation designating voltage $V_{data}$ to the data line DL via the operational amplifier 46 now serving as a voltage follower. Consequently, the ground potential GND is applied to the node N1 through the transistor 1 in its ON state, while the gradation designating voltage $V_{data}$ on the data line DL is applied to the node N2 through the transistor 2 in its ON state. As a result, the gradation designating voltage $V_{data}$ is held in the capacitor 4. In other words, between the gate and source electrodes of the transistor 3, a potential difference is caused which is equivalent to the total sum of the threshold voltage $V_{th3}$ specific to the transistor 3 and the gradation effective voltage $V_{real}$.

In the subsequent light emission stage 320, the selector line SL is set to its "L" level, and the power supply voltage line VL has a high potential supply voltage, i.e. Ve, applied while the switch 47 is turned off in response to the switch control signal I/O. As a consequence, the transistors 1 and 2 become the OFF state thereof, and thereby a light-emission driving current $I_{em}$ flows from the power supply voltage line VL with the high potential or the voltage Ve through the transistor 3 to the organic EL device OEL so as to allow the organic EL device OEL to emit light with the luminance gradation corresponding to the intensity of the light-emission driving current $I_{em}$. Now, the light-emission driving current $I_{em}$ passing through the transistor 3 corresponds to the voltage between the gate and source electrodes of the transistor 3, i.e. the summation of the threshold voltage $V_{th3}$ specific to the transistor 3 and the gradation effective voltage $V_{real}$, which is held in the capacitor 4.

The writing and light-emission operations 310 and 320 of the display drive operation 300 are repeated for every one line of the externally input data.

Figure 3:
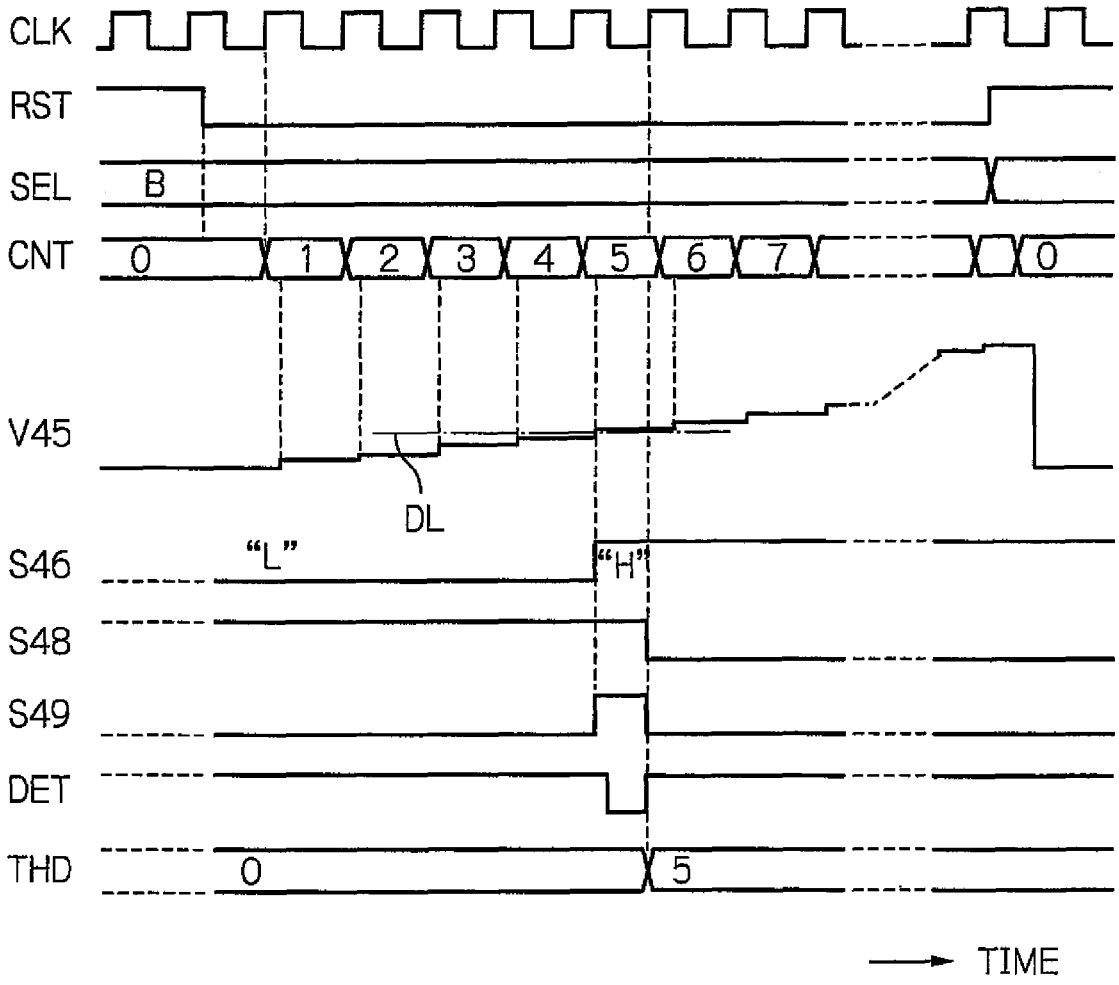
FIG. 3 is a timing diagram useful for understanding how the data line driver shown in FIG. 1 detects a threshold voltage.

FIG. 3 is a timing diagram showing the threshold voltage detection operation 200 by the data line driver 40 shown in FIG. 1.

In the voltage converging stage 220 of the threshold voltage detection operation 200, the reset signal RST is at its "H" level, so that the count value CNT of the counter 41 is zero. In addition, the selector 43 selects the count value CNT in response to the selection signal SEL, whose value is equal to two. According to the count value CNT of zero, the digital-to-analog converter 44 outputs a voltage, e.g. −6 V, which is adequately lower than the ground potential GND and whose absolute value is defined larger than the sum of the threshold voltages $V_{th2}$ and $V_{th3}$ of the transistors 2 and 3.

When the level of the reset signal RST changes from its "H" to "L" level in the voltage reading stage 230, the reset status of the counter 41 is released, and thereby the count value CNT of the counter 41 is counted up one by one in synchronous with the clock signal CLK. The count value CNT is fed through the selector 43 to the digital-to-analog converter 44 so as to be converted to the analog voltage V44, and then, by means of the voltage adder 45, added to the gradation effective voltage $V_{real}$ delivered from the gradation voltage generator 30. At this stage 230, since the gradation effective voltage $V_{real}$ is the non-light emitting display voltage $V_{zero}$ corresponding to the black pixel data, the value of the voltage V45 applied to the operational amplifier 46 or the voltage comparator is equivalent to that of the voltage V44.

The operational amplifier 46 compares the voltage V45 with the voltage on the data line DL. While the count value CNT is small, the voltage output from the digital-to-analog converter 44 is lower than the voltage on the data line DL, so that the signal S46 delivered from the operational amplifier 46 is at its "L" level. When the count value CNT increases so that the output voltage of the digital-to-analog converter 44 becomes larger than the voltage on the data line DL, the signal S46 turns to its "H" level.

The point is detected where the signal S46 is changed from its "L" level to "H" level by means of the flip-flop 48 and AND gate 49, which in turn generates a signal S49 while the NAND gate 50 and the inverter 51 generate the detection signal DET which is in synchronous with the positive-going edge of the clock signal CLK on the basis of the signal S49. Then, the count value CNT is held in the flip-flop 42 in time with the positive-going edge of the detection signal DET and is output as the threshold detection data THD to the threshold data latch 60.

During the voltage reading stage 230, the data line DL is connected via the transistor 2 in its ON state to the node N2. The electric potential of the node N2 corresponds to the electric potential at the one plate of the capacitor 4 in which the electrical charges equivalent to the threshold voltage Vth3 of the transistor 3 are accumulated. On the other hand, the electric potential of the node N1 corresponds to the potential at the other plate of the capacitor 4 storing the electrical charges equivalent to the threshold voltage $V_{th3}$ of the transistor 3, and the node N1 is grounded GND by the transistor 1 when rendered to its ON state. That is, the electric potential of the data line DL measured by the data line driver 40 corresponds to the potential of the source electrode of the transistor 3. Thus, the threshold voltage $V_{th3}$ of the transistor 3 can be detected based on the threshold detection data THD.

As described above, in accordance with the embodiment of the display driver circuit 100, the connection of the operational amplifier 46 of the data line driver 40 is changed so as to function either as a voltage follower to drive the data line DL, or as a voltage comparator when the threshold voltage $V_{th3}$ of the transistor 3 for driving the light-emission driver circuit DC is measured through the data line DL. As a consequence, the digital-to-analog converter 44 for generating the detection voltage $V_{pv}$ and the compensation voltage $V_{pth}$ can be utilized as part of the analog-to-digital converter, thereby making the circuitry smaller in size than conventional circuitry to which a separate analog-to-digital converter would be provided. The present invention therefore has an advantage in reducing the size of the display driver circuit having circuitry for compensating the fluctuation in light-emission properties due to the drive history of the drive transistors for driving light-emission devices.

Figure 4:
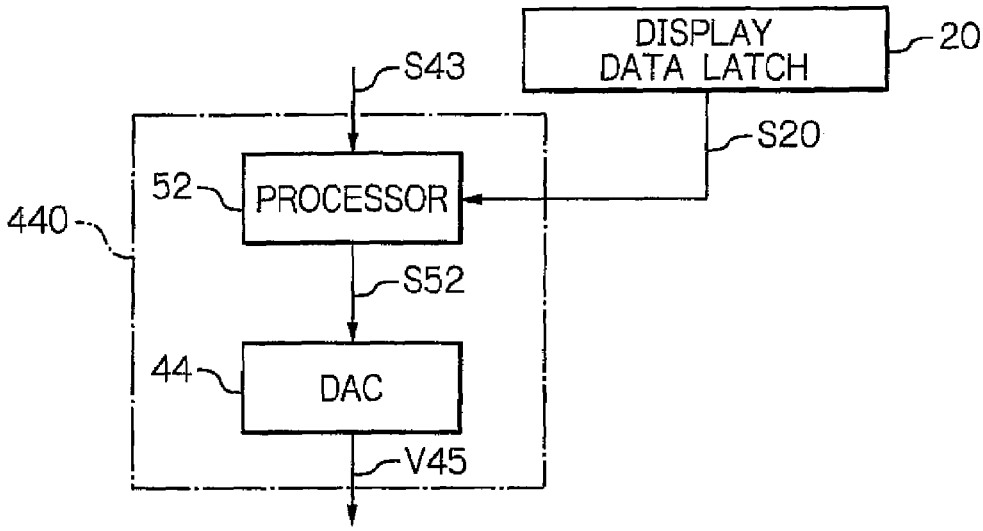
FIG. 4 is a schematic block diagram showing a digital-to-analog converter in an alternative embodiment in accordance with the present invention.

The invention is not limited to the specific embodiment described above, but can be modified in various ways such as follows. According to the embodiment shown in and described with reference to FIG. 1, the analog gradation effective voltage $V_{real}$ output from the gradation voltage generator 30 on the basis of data to be displayed is added to the analog voltage V44 delivered from the digital-to-analog converter 44 by means of the voltage adder 45 in the DAC section 440. Alternatively, as shown in FIG. 4, the circuitry can be configured such that the digital data S43 output from the selector 43 and digital data to be displayed S20 output from the display data latch 20 are input to a digital processor 52, which has its output connected to the input of the digital-to-analog converter 44, thereby allowing the digital-to-analog converter 44 to convert an addition result S52 into a corresponding analog voltage V45. Such configuration requires to add the digital processor 52 to the circuitry, but then the gradation voltage generator 30 and the voltage adder 45 are not necessary.

The digital processor 52 thus involved may be a digital-type voltage adder, by way of example. In this case, the digital data S43 output from the selector 43 and digital data to be displayed delivered from the display data latch 20 may be added in digital value by means of such a voltage adder, and the digital-to-analog converter 44 then converts the result S52 into the analog voltage V45.

Alternatively, the digital processor 52 may be a processor system. In the aforementioned embodiment, the analog gradation effective voltage $V_{real}$ output from the gradation voltage generator 30 based on data to be displayed and the analog voltage V44 output from the digital-to-analog converter 44 based on the threshold compensation data are added to each other by the voltage adder 45 in order to drive the data line DL. Alternatively, the processor system can be used to correct data to be displayed on the basis of the threshold compensation data, and then the digital-to-analog converter 44 converts the display data thus corrected S52 into the analog voltage V45 to drive the data line DL. As a matter of course, any type of processors other than the digital voltage adder or the processor stated above may be employed, which can output the analog voltage V45 for driving the data line DL.

Figure 5:
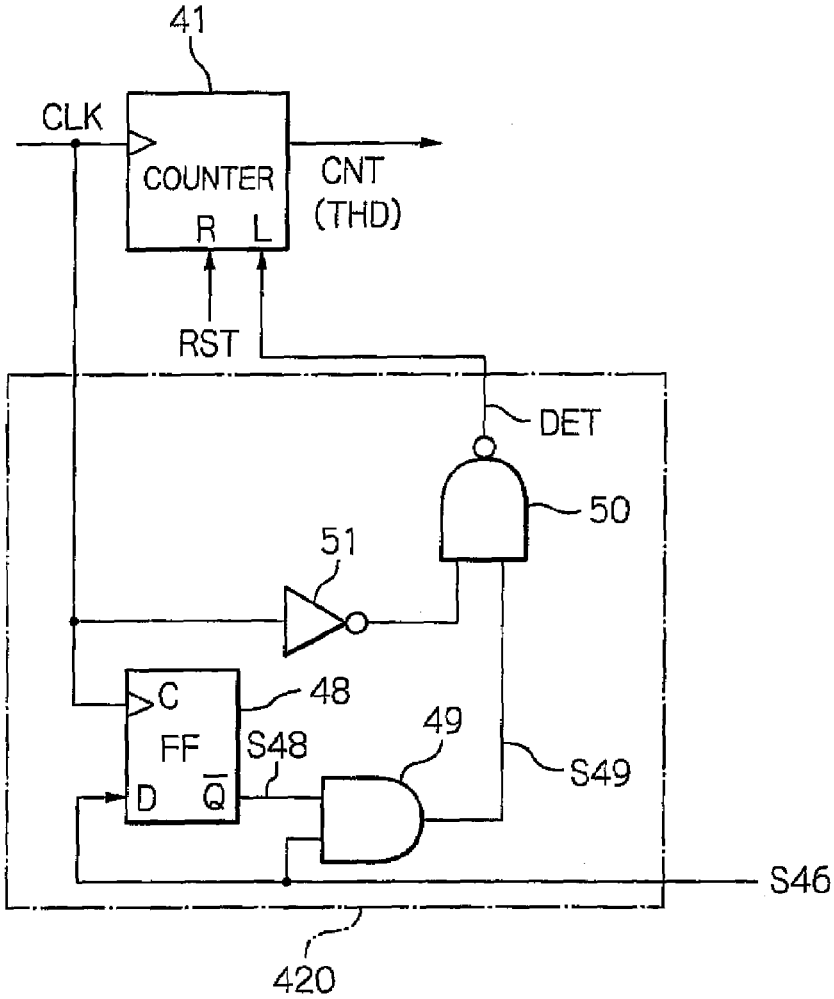
FIG. 5 is a schematic block diagram showing a counter and a data holding section in a further alternative embodiment in accordance with the present invention.

The counter 41 arranged in each data line driver 40 may be provided with a count latch terminal L and adapted to have a count latch function of holding a count value in response to the positive-going or negative-going edge of a signal level input on the terminal L to to produce the output CNT accordingly. In addition, the counter 41 may be designed to receive on the count latch terminal L the detection signal DET output from the NAND gate 50. The configuration example of the connection of a data holder 420 and the counter 41 according to this case is shown in FIG. 5. In such configuration, such a flip-flop corresponding to the flip-flop 42 for holding the count value CNT is not needed. The count value CNT can be output as the threshold detection data THD to the threshold data latch 60.

There is provided a display driving method for supplying a gradation signal according to externally input display data to be displayed to display pixels, each of which has a current-controlled light-emitting device and a drive transistor for supplying a drive current to the light-emitting device, to thereby allow the light-emitting devices to emit light with a luminance gradation, the method comprising: executing a voltage applying process for supplying, when measuring a threshold voltage prior to a display operation, detection data corresponding to a detection voltage for measuring the threshold voltage of the drive transistor to a digital-to-analog converter to convert the supplied data into a corresponding analog voltage, and outputting the analog voltage via an operational amplifier of voltage follower to a data line connected to the drive transistor; executing, after the voltage applying process, a voltage converging process for stopping the supply of the detection voltage for threshold measurement to the data line to thereby converge the voltage of the data line to the threshold voltage level of the drive transistor; executing, after the voltage on the data line is converged to the threshold voltage level, a voltage reading process for supplying to the digital-to-analog converter with a count value of a counter, which performs a count operation in synchronous with a clock signal, to thereby convert the count value into a corresponding analog voltage, comparing the analog voltage with the voltage on the data line by the operational amplifier, and storing in the memory the count value of the counter as threshold data at the time when a comparison result is inverted; and executing a display process during the display operation for generating an analog voltage corresponding to data into which the display data held in a register are corrected with the threshold data stored in the memory to output the analog voltage as the gradation signal via the operational amplifier of voltage follower to the data line.

The entire disclosure of Japanese patent application No. 2008-82319 filed on Mar. 27, 2008, including the specification, claims, accompanying drawings and abstract of the disclosure is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A display driver circuit for supplying a gradation signal according to externally input display data to be displayed to a display pixel having a current-controlled light-emitting device and a transistor for supplying a drive current to the light-emitting device to thereby allow the light-emitting device to emit light with a luminance gradation, comprising:

a memory for storing compensation data based on a measured value of a threshold voltage of said transistor;

a register for holding the display data; and a data line driver having a data line connected to the transistor for measuring the threshold voltage of the transistor through the data line to produce the compensation data and store the compensation data in said memory during a threshold voltage measurement, which includes a voltage applying process for applying a detection voltage to the data line, a voltage converging process for making the applied voltage converge to the threshold voltage level of the transistor and a voltage reading process for storing the threshold data in said memory, and is carried out prior to a display operation for getting the light-emitting device to emit the light, and, during the display operation, for correcting the display data held in said register with the compensation data stored in said memory to output the gradation signal on the data line, said data line driver comprising:

a counter for executing, during the voltage reading process, a counting operation in synchronous with a clock signal;

a selector for selecting detection data to feed a detection voltage for threshold measurement to the data line during the voltage applying process, selecting a count value of said counter during the voltage converging process and the voltage reading process, and selecting and outputting the compensation data stored in said memory during the display operation;

a digital-to-analog converter circuit for converting, during the threshold voltage measurement, the data selected by said selector into a corresponding analog voltage to output the analog voltage, and supplying, during the display operation, an analog voltage corresponding to data into which the display data held in said register are corrected with the compensation data selected by said selector;

an operational amplifier serving as a voltage follower during the voltage applying process and the display operation for applying a voltage output from said digital-to-analog converter circuit to the data line, and serving as a voltage comparator during the voltage converging process and the voltage reading process for comparing the output voltage from said digital-to-analog converter circuit with the voltage on the data line; and a data holder for monitoring a comparison result from said operational amplifier during the voltage reading process, said data holder being responsive to the result being inverted to hold the count value of said counter as the threshold voltage.

2. The display driver circuit in accordance with claim 1, further comprising a gradation voltage generator for generating a first analog voltage according to the display data, said digital-to-analog converter circuit comprising a digital-to-analog converter for converting the data selected by said selector into a second analog voltage, and a voltage adder for adding the first and second analog voltages to each other to output a resultant voltage to said operational amplifier.

3. The display driver circuit in accordance with claim 1, wherein said digital-to-analog converter circuit comprises a processor for calculating a digital value on a basis of the data selected by said selector and the display data, and a digital-to-analog converter for converting the digital value into a corresponding analog voltage to output the analog voltage to said operational amplifier.

4. The display driver circuit in accordance with claim 1, wherein said counter is connected to an output of said data holder to receive a signal for stopping the counting operation.

* * * * *